US008756725B2

(12) United States Patent
Piegdon et al.

(10) Patent No.: US 8,756,725 B2
(45) Date of Patent: Jun. 24, 2014

(54) PATIENT TRANSFER DEVICE

(71) Applicant: ArjoHuntleigh, Bedfordshire (GB)

(72) Inventors: Samuel Piegdon, Amherst, NY (US); Alejandro Manunta, Amherst, NY (US)

(73) Assignee: Arjohuntleigh, Bedfordshire (GB)

( * ) Notice: Subject to any disclaimer, the term of this patent is extended or adjusted under 35 U.S.C. 154(b) by 0 days.

(21) Appl. No.: 13/708,247

(22) Filed: Dec. 7, 2012

(65) Prior Publication Data

US 2013/0145549 A1 Jun. 13, 2013

Related U.S. Application Data

(60) Provisional application No. 61/568,749, filed on Dec. 9, 2011.

(51) Int. Cl.
*A61G 5/00* (2006.01)
*A61G 1/003* (2006.01)

(52) U.S. Cl.
USPC ..... 5/81.1 R; 5/81.1 HS; 5/706; 5/707

(58) Field of Classification Search
USPC ..... 5/81.1 R, 81.1 HS, 691, 706, 707, 5/710–715, 731
See application file for complete search history.

(56) References Cited

U.S. PATENT DOCUMENTS 5,067,189 A 11/1991 Weedling et al.
5,561,873 A * 10/1996 Weedling ..... 5/713
6,073,291 A * 6/2000 Davis ..... 5/711
6,467,106 B1 * 10/2002 Heimbrock ..... 5/81.1 C
6,739,001 B2 * 5/2004 Flick et al. ..... 5/425
6,898,809 B2 * 5/2005 Davis ..... 5/81.1 R
7,373,680 B2 5/2008 Davis
7,712,170 B2 5/2010 Davis
7,725,963 B2 * 6/2010 Johnson ..... 5/81.1 R
7,861,335 B2 * 1/2011 DeLuca et al. ..... 5/81.1 R
2002/0166168 A1 * 11/2002 Weedling et al. ..... 5/81.1 R
2005/0076437 A1 * 4/2005 Johnson ..... 5/81.1 R

FOREIGN PATENT DOCUMENTS

WO 2004/043792 A2 5/2004
WO WO 2007/133589 A1 11/2007

* cited by examiner

*Primary Examiner* — William Kelleher
*Assistant Examiner* — David R Hare
(74) *Attorney, Agent, or Firm* — Finnegan, Henderson, Farabow, Garrett & Dunner, LLP

(57) ABSTRACT

A patient support device. The support device includes a first side for contacting a surface, the first side having a perimeter portion and an inner portion. The support device further includes a second side for contacting a patient, the second side having a perimeter portion and an inner portion. The support devices also includes at least one baffle interconnected between the first and second sides. When in an unloaded state, the perimeter portion of the first side is in contact with the surface and the inner portion of the first side is spaced a first distance away from the surface. When in a loaded state the perimeter portion of the first side is in contact with the surface and the inner portion of the first side is spaced a second distance away from the surface. The second distance is less than the first distance.

20 Claims, 3 Drawing Sheets

PATIENT TRANSFER DEVICE

CROSS-REFERENCE TO RELATED APPLICATIONS

This application claims the benefit of priority from U.S. Provisional Application No. 61/568,749, filed Dec. 9, 2011, which is incorporated herein in its entirety.

FIELD OF THE DISCLOSURE

This disclosure generally relates to patient transfer devices and, in particular, patient transfer devices for transferring and assisting in transferring patients from one surface to another, e.g., between beds, tables, gurneys, and/or other surfaces in a medical, hospital, and/or other environments.

SUMMARY OF THE DISCLOSURE

The disclosure relates to a patient transfer device. The transfer device may include an inflatable mattress or air pallet having a patient support portion for receiving and/or supporting a patient. The transfer device may also include elongated bounding portions bounding the patient support portion at least on opposing sides. The patient support portion has an upper side and an opposing lower side. The lower side may be curved inwardly from the bounding portions to thereby curve upwardly away from a surface, e.g., a bed, table, gurney, or other underlying surface on which the mattress rests when the patient support portion has no or low loads thereon. For example, the lower side of the transfer device may be curved inwardly and upwardly when no patient is on the patient support portion. When a patient is supported on the support portion, the patient support portion may bow downwardly and may cause the lower side of the patient support portion to flatten and approach the underlying surface.

The transfer device may be formed of upper and lower sheets of flexible material such as vinyl, rubber, rubberized or otherwise "sealed" fabric. Exemplary materials include, for example, urethane-coated nylon or polyester fabric, or similar materials. It is contemplated that the upper and lower sheets of the transfer device may alternatively be formed of a substantially inelastic material. The upper and lower sheets may be joined at their perimeters by sewing, thermal or ultrasonic welding, adhesives, and/or other suitable methods of attachment. It is contemplated that the transfer device may be void of any metallic components. As it may be radiolucent and MRI safe.

The lower sheet (and thus the lower side of the patient support portion) may have air egress apertures defined therein so that when air is supplied to the transfer device, i.e., to inflate the mattress, a portion of the air may escape through the egress apertures and may reduce friction between the transfer device and the underlying surface. For example, the escaping air may form a layer of air, e.g., an air bearing, between the bottom sheet of the transfer device and the underlying surface that, at least to some degree, cushions and/or supports the transfer device. It is contemplated that an air layer may be formed when the transfer device is in a loaded state, e.g., when a patient is supported by the transfer device, and in an unloaded state, e.g., when a patient is not supported by the transfer device. In particular, an air layer may be formed when the transfer device is in an unloaded state as the bounding portions may extend completely or partially around the perimeter of the upwardly-curving patient support portion, may contact the underlying support surface, and may form a seal effectively surrounding the patient support portion. It is contemplated that gaseous fluids other than, or in addition to, air may be used to inflate the transfer device.

The bounding portions may be, when inflated, beamlike or tubelike, with a tendency to resist bending. As such, they may form substantially, or effectively, semi-rigid pontoon-like boundaries about the patient support portion, i.e., about the perimeter of the patient support portion. The bounding portions, in conjunction with the downwardly-yielding patient support portion, thereby resist a phenomenon commonly referred to as "taco-ing"—the tendency of a transfer device to arc upward and curve about the length of a patient's body when the patient rests upon the transfer device, with the transfer device resembling a shape approximating a "taco shell" curving about the patient's body.

The substantially concave curvature of the lower side of the patient support portion may be formed by joining tethers, e.g., baffles as described in more detail below, between the upper and lower sheets at their areas corresponding to the patient support portion. The tethers may be any suitable structure configured to extend from and interconnect the lower side to the upper side, and may include baffles, straps, or other fasteners, and may be substantially flat or cylindrical. The tethers may delimit and establish the spacing between the upper and lower sheets as the interior volume of the transfer device, including the volume between the upper and lower sheets, is filled with air or other gas. The tethers located nearer to the perimeters of the sheets may have a greater length (and thus greater spacing between the upper and lower sheets), while the tethers located further from the perimeters of the sheets, i.e., closer to the middle of the patient support portion, may have shorter length (and thus lesser spacing between the upper and lower sheets). As a result, the sheets may be held in more closely spaced relationship further from their perimeters, and thus, further from the bounding portions, thereby defining the concave curvature of the patient support portion.

The tethers may be arranged in the form of an array of, for example, substantially parallel, elongated, continuous strip-like baffles that extend between the opposing lateral bounding portions of the patient support portion of the transfer device. The baffles may be formed of the same material as the upper and lower sheets. Exemplary tethers or baffles may be disposed between the lateral edges of the lower sheet and the lateral edges of the upper sheet. An exemplary baffle may include a substantially linear top edge joined to the upper sheet and a substantially concavely curving lower edge joined to the lower sheet of the mattress. The curving lower edge may thereby define the concave curvature of the lower sheet. It is contemplated that the curvature of the lower edge of an exemplary baffle may include any shape such that it defines a concave-like shape as described herein, that is, a shape that may define the shape of the lower sheet to be spaced apart from the underlying supporting surface.

At different areas of the patient support portion, adjacent baffles or tethers may be more widely spaced apart along the upper sheet than along the lower sheet. At locations along the upper sheet where the baffles or tethers may be more widely spaced, the areas of the upper sheet between the baffles may have a greater tendency to bulge upwardly along the upper side of the patient support portion. This wider spacing may be provided, for example, at the area of the patient support portion corresponding to where a patient's head would rest. As such, the resulting upwardly-bulging area of the patient support portion may define a pillow-like raised area. In addition or alternatively, the baffles or tethers may be relatively narrower spacing near the foot of the patient support portion as compared to a wider spacing near the neck and/or head regions. As such, the upper side of the patient support portion may bulge upwardly at these regions to support the head and neck. It is contemplated that the transfer device may include safety straps and handles along the bounding portions of the mattress.

DETAILED DESCRIPTION

Figure 1A:
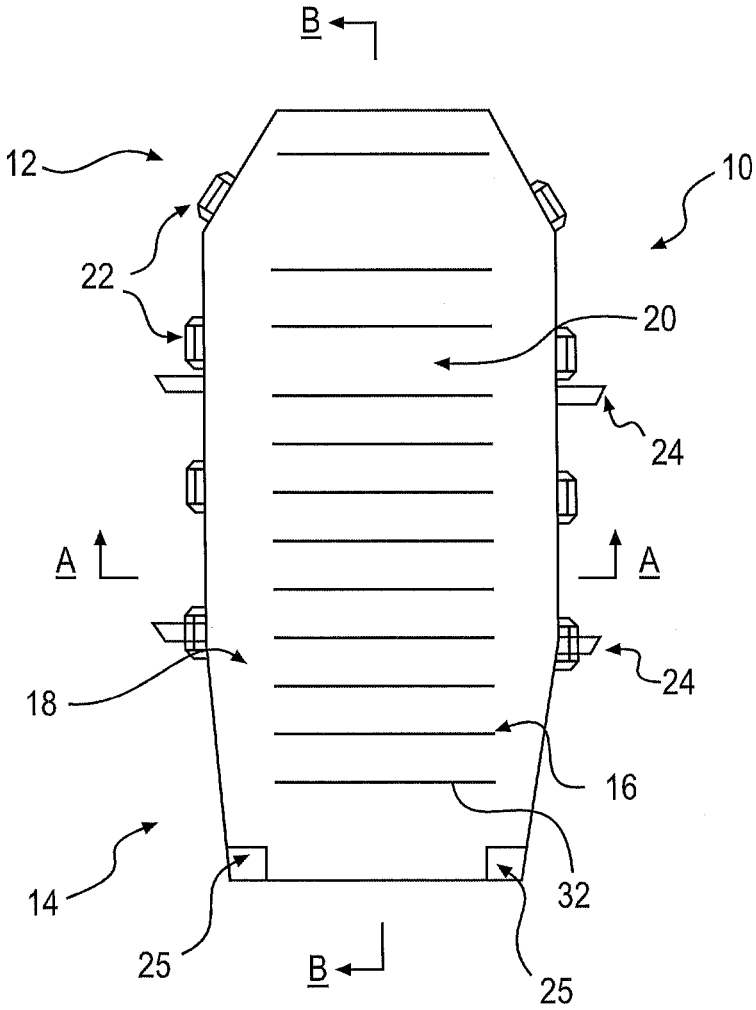
FIG. 1A is a schematic top-view illustration of a patient transfer device in accordance with the present disclosure.

FIG. 1 illustrates a patient support device 10. The support device 10 may include a head section 12 and a foot section 14 and may also include first and second patient bounding portions 16, 18 disposed generally along lateral sides of the support device 10. The first and second bounding portions or pontoons 16, 18 may extend substantially from the head section 12 to the foot section 14. The support device 10 may also include a patient support portion 20 generally disposed with an inner portion of the device relatively disposed between the bounding portions 16, 18. The support device 10 may be configured as an inflatable mattress assembly or air pallet apparatus, having an internal plenum, for supporting and transferring a patient.

The support device 10 may also include one or more handles 22 and one or more patient securing straps 24 (only partially shown for clarification purposes, and without their associated buckles or other fasteners). It is contemplated that four handles 22 may be provided on each lateral side of the transfer device 10, located approximately above and below the shoulders, and above and below the hips (based on 50th percentile female shoulder breadth). It is also contemplated that two straps 24 may be provided on each lateral side of the transfer device 10, located approximately at a thorax region and just above the knees (based on 50th percentile male data).

The transfer device 10 may also include one or more inlet ports or valves 25. The inlet ports or valves 25 may be disposed at or adjacent to the corners of the foot of the mattress, with each allowing attachment of a hose from a blower or pump to the mattress. The blower or pump may supply a continuous or intermittent supply of air or other gas to the transfer device 10. The inlet ports or valves 25 may be adapted to receive conventional hoses, e.g., hoses for pallet-type mattresses, thereby allowing use of the mattress by care providers currently using air mattress devices.

Figure 1B:
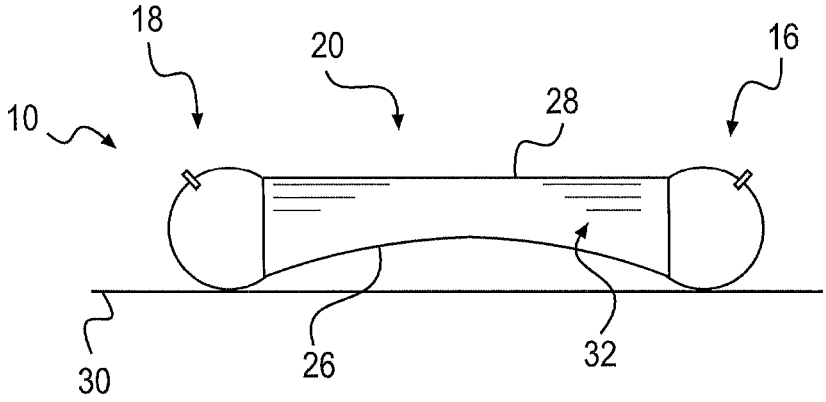
FIG. 1B is a schematic cross-sectional illustration, taken along line A-A of the patient transfer device of FIG. 1A, in an unloaded state.
Figure 1C:
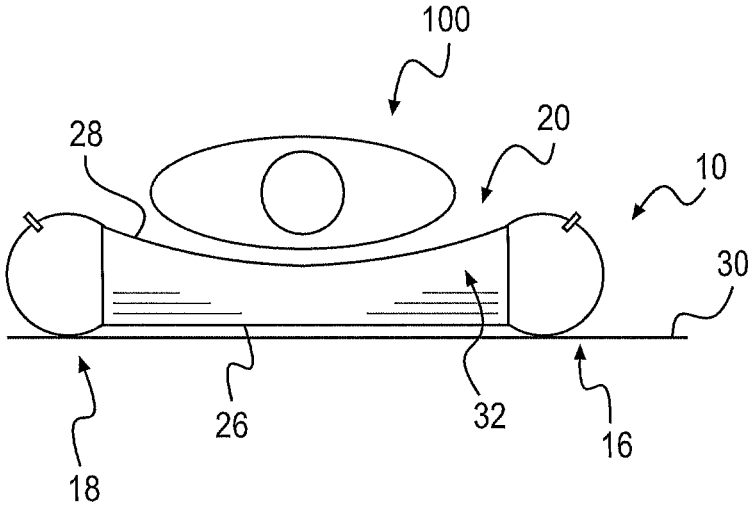
FIG. 1C is a schematic cross-sectional illustration, taken along line A-A of the patient transfer device of FIG. 1A, in a loaded state, e.g., when supporting a patient.

FIGS. 1B and 1C respectively illustrate the support device 10 in two states—an unloaded state, e.g., without a patient (FIG. 1B) and a loaded state, e.g., with a patient (FIG. 1C). The bounding portions 16, 18 may have a generally rounded shape with a curved outward surface. The bounding portions 16, 18 may also be generally void of internal structures such that they form generally pontoon shaped tube-like or beam-like structures when the support structure 10 is inflated. The support structure 10 may also include a plurality of tethers or baffles 32 disposed laterally between the bounding portions 16, 18.

As will be explained further, a downward force due to the weight of a patient 100 (FIG. 1C) may cause a downward yielding of the patient support portion 16 such that the support device 10 has a cradling effect with respect to a patient but avoids a "taco-ing" effect. For example, a patient may have a tendency to settle toward the center of the patient support portion 20 with the bounding portions 16, 18 situated along the patient's sides. As will be explained below, the bounding portions 16, 18 may be relatively larger in size and extend above, below, or both above and below the patient support portion 20. In addition, the patient support 10 may slightly curve to form a shallow depression and cradle the patient without significantly curving forming what is commonly referred to as "taco-ing" the patient. This cradling effect may provide a safer and more comfortable feeling for the patient as they are transferred between different surfaces, e.g., from a gurney to a bed, on support device 10. For example, the patient may have a lesser risk of rolling off the support device 10 when being transferred, especially when they are transferred between uneven surfaces but may not be "taco-ed" by the support device 10. It is contemplated that straps 24 can also be fastened as a safety precaution to help prevent the patient from exiting, e.g., rolling off the support device 10. It is also contemplated that because of the cradling (and straps, if used), patients may not feel like they could roll off the support device, and thus may tend to be calmer and more comfortable during transfers.

With reference to FIG. 1B, the patient support portion 20, when in an unloaded state, may have a substantially concave shape on a first or lower side 26, relative to an underlying surface 30, and a substantially planar or flat shape on a second or top side 28. It is contemplated that first side 26 may have a substantially concave shape or any shape configured to be spaced away from the surface 30 when the support device 10 is in an unloaded state. With reference to FIG. 1C, the patient support portion 20, when in a loaded state, may have a substantially planar shape on the first or lower side 26, relative to the surface 30, and a substantially concave shape on the second or top side 28. The support device 10 and, in particular, the first and second sides 26, 28, may be configured to transition and change shape due to the weight of a patient applying a force, e.g., a downward force, relative to the surface 30.

Figure 2:
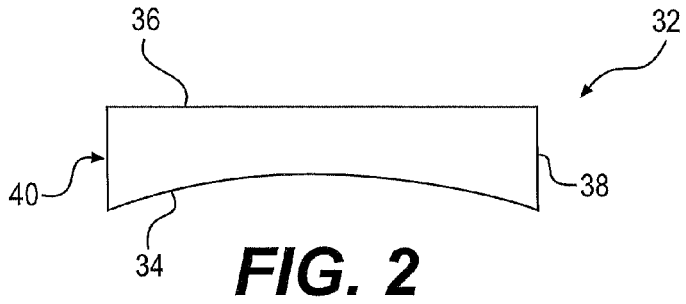
FIG. 2 is a schematic side-view illustration of a tether or baffle of the patient transfer device of FIG. 1A.

FIG. 2 illustrates an exemplary tether or baffle 32. The baffle 32 may include a substantially concave first or bottom edge 34, a substantially linear second or top edge 36, and lateral edges 38, 40. As such, lateral edges 38, 40 may have a relatively longer length between first and second edges 34, 36 as compared to a middle portion of the baffle 32. It is contemplated that the first edge 34 may have any shape such that the relative length between first and second edges 34, 36 adjacent the lateral edges 38, 40 is greater than the middle portion of the baffle 32. It is contemplated that the substantially concave shape of the first or lower edge 34 may be substantially arcuate or curving, e.g., formed from a plurality of substantially straight sections that together form a substantially curved shape, may be generally symmetric, asymmetric, or irregular in shape, and/or may have any other suitable shape.

When the transfer device 10 is inflated, the bounding portions 16, 18, which preferably lack any internal tethers or baffles, inflate into pontoon-like forms, with the air pressure urging the bounding portions 16, 18 into a substantially circular shape. The approximate diameter of each circle, when measured vertically, e.g., along a direction substantially normal to the underlying supporting surface 30, may be greater than the length of the lateral edges 38, 40 of the baffles. As such, each bounding portion or pontoon 16, 18 may be large enough to form a barrier to reduce the likelihood that the patient will roll off the transfer device 10 while patient supporting portion 20 may be in a substantially planar or flat configuration.

Figures 3A, 3B:
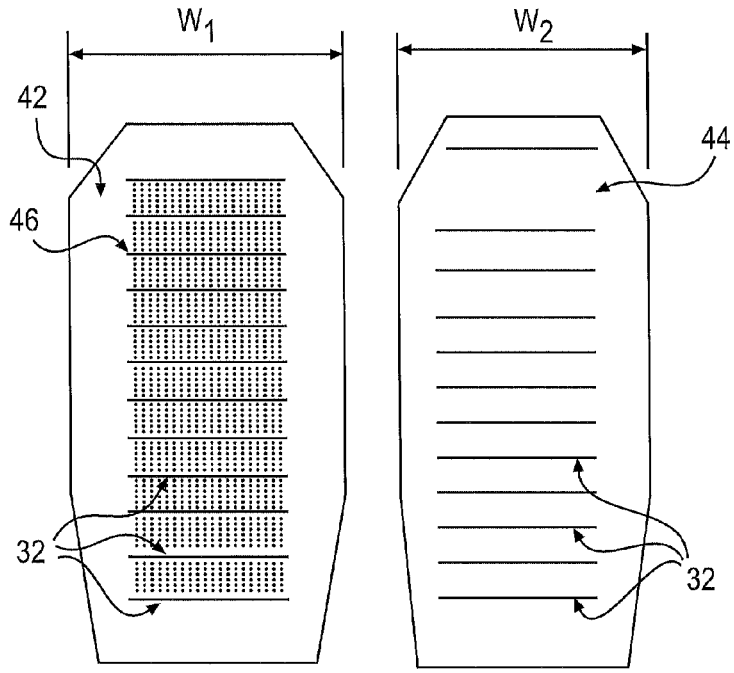
FIG. 3A is a schematic illustration of a first or lower sheet of the patient transfer device of FIG. 1A.
FIG. 3B is a schematic illustration of a second or upper sheet of the patient transfer device of FIG. 1A.

The transfer device 10 may be formed from a first or bottom sheet 42 (FIG. 3A) and a second or top sheet 44 (FIG. 3B). The first sheet 42 may have a shape as shown in FIG. 3A substantially corresponding to the general shape of the transfer device 10. The second sheet 44 may have a substantially similar shape but different dimensions. In particular, the outer perimeter dimensions of the first and second sheets 42, 44 may be joined together. However, a width $W_1$ of the first sheet 42 may be greater than a width $W_2$ of the second sheet 44. As such, a perimeter seam between the first sheet 42 and the second sheet 44 may be located closer to the approximate center of the second sheet 44 than the approximate center of the first sheet 42. That is, the perimeter seam may not be aligned with the general mid-point of the bounding portions 16, 18. It is contemplated that the lengths and/or widths of the lower and upper sheets 42, 44 may be selected so that the bounding portions may have the desired size and/or curvature after inflation.

Although of different overall shape, the first and second sheets may also be joined to one another via the plurality of baffles 32. For example, the respective first edges 34 of baffles 32 may be joined to first sheet 42 and the respective second edges 36 of baffles 32 may be joined to second sheet 44. It is contemplated that the respective lateral edges 38, 40 of baffles 32 may not be joined to the first or second sheets 42, 44. As such, the relative size of the baffles 32, and in particular the length of the lateral edges 38, 40 may define the relative spacing between the bottom and top sides 26, 28 of the transfer device 10 and the relative size and shape of the bounding portions 16, 18. See FIGS. 1B and 1C. It is also contemplated that the baffles 32 may be respectively joined to the bottom and top sheets 42, 44 at locations illustrated in FIGS. 3A and 3B, or other according to other patterns.

The first or bottom sheet 42 may include a plurality of apertures 46 formed therein configured to permit air or other gas to escape from the interior volume of the transfer device 10 when it is inflated. The apertures 46 may be arranged in any suitable pattern and may be disposed in the patient support portion 20 of the transfer device 10. The apertures 46 are generally small enough to retain a majority of the air within the transfer device 10 that may be supplied to the interior of the transfer device 10 via one or more of the ports or valves 25 (FIG. 1A) from a supply. It is contemplated that the apertures 46 may be distributed about any area and with any arrangement of the lower sheet as desired, but may be more densely concentrated in areas that are likely to support a majority of a patient's weight, e.g., the patient support portion 16, whereas the bounding portions 16, 18 may be void of apertures 46.

The second or top sheet 44 may be formed from a first layer configured to retain the air within the interior of the transfer device when inflated and a second, exterior layer permanently adhered or removably attached to an outward facing side of the first layer. The second layer may be configured to provide comfort to the patient. It is contemplated that the second layer may be removably affixed to the first layer such that it can be temporarily removed from the remainder of the transfer device 10 for washing and reattached. It is contemplated that the first and second layers of the second or top sheet 44 may have substantially the same overall dimensions. It is further contemplated that each of the first or bottom sheet 46, the second or top sheet 48 (including the first and second layers), and the baffles 32 may be a generally flat sheet of material, may be substantially inelastic, and/or may be formed from any suitable material.

Figure 4:
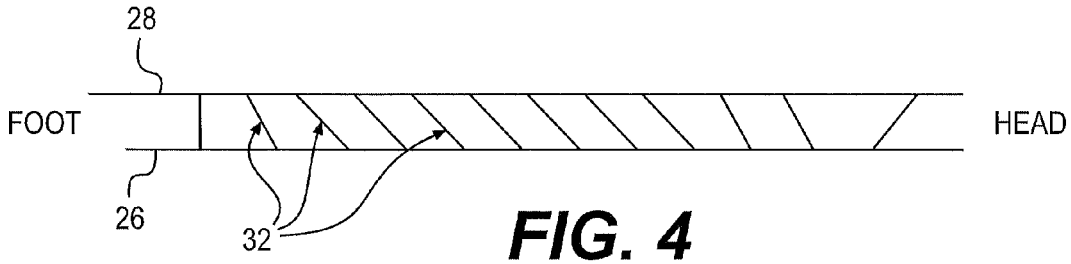
FIG. 4 is a schematic cross-sectional illustration, taken along line B-B of the patient transfer device of FIG. 1A.

FIG. 4 illustrates a lateral cross-sectional view of the transfer device 10 showing an exemplary arrangement of baffles 32. As shown, the baffles 32 may be at different angles, e.g., not parallel to one another, along all of or portions of the longitudinal length of the mattress. As such, the baffles may affect the relative distance (or height) between the first or bottom side and the second or top side of the patient support portion 20. For example, a large spacing and opposing baffle angles adjacent the head end of the transfer device 10 may create a pillow for the patient's head. Further, consistent baffle angles through a middle of the transfer device 10 may keep the height of the transfer device 10 substantially uniform throughout the patient's torso. It is contemplated that this arrangement may also help to deter "taco-ing." In the upper and lower sheets of FIG. 2, the upper and lower sheets have different angles between each side.

The size and shape of the baffles 32, in particular the substantially concave shape of the first or bottom edge 34, and the pontoon-like bounding portions 16, 18 may promote the tendency of the transfer device 10 to have a downwardly concave shape, at least along the lower side of the patient support portion 16, when the transfer device is inflated and unloaded, e.g., without weight on it. When weight (such as a patient) is added, the downward curvature may help keep the transfer device 10 from curving upwardly about the sides of the patient's body, thereby reducing or eliminating "taco-ing" effects. The baffles 32 and pontoon-like bounding portions 16, 18 may also provide a more effective "air bearing" via the apertures 46 of the first or bottom side 26 of the transfer device 10. For example, when weight is placed on the mattress, the substantially concave lower surface may generally flatten out, distributing a relatively thin film of air along the lower surface between the bottom of the transfer device 10 and the underlying surface 30 as air escapes the apertures 46. This thin film may reduce the friction between the transfer device 10 and the surface 30 and may allow for easier transfer and movement of a patient. Additionally, the pontoon-like bounding portions, which may have an approximate diameter larger than the length of the baffles 32, may form a seal with the surface 30 that may help to keep the air emitted from the lower side of the patient support portion, via the apertures 46, "trapped" under the patient support portion 20, and may allow for a more effective air bearing. In contrast, the bottom side of patient mattresses that curve significantly, "taco-ing" a patient, have the tendency to have their respective perimeters lift off the underlying surface, releasing any air-bearing that may exist and have the tendency to have direct contact points between the bottom of the mattress and the surface. Both of these may increase friction between the mattress and the surface, which may increase the force required to move or transfer the mattress and thus the patient.

When the mattress has weight on it (particularly the weight of a patient's body), as shown in FIG. 1B, the first or bottom side 26 of the patient support portion 20 may flatten. When doing so, the bounding portions or pontoons 16, 18 rotate and allow the second or top side 28 of the patient support portion 16 to become substantially concave in shape. This movement thereby creates a shallow cradling effect on the patient's body. This cradling may urge the patient's body towards the center of the mattress, and may reduce the risk of the patient rolling off during a transfer. Additionally, this movement may help create an air pocket beneath the transfer device between the bounding portions and help retain air beneath the transfer device. It is contemplated that retaining air beneath the transfer device, as compared to the rapid escape of air, may also help reduce the effects of "taco-ing". In addition, due to the limited contact area between the transfer device and the underlying surface, the mattress may have limited friction when slid along the surface. In addition, friction may be further reduced by the aforementioned air bearing. It is further contemplated that friction may be further reduced by coating the bounding portions with a low-friction material.

The drawings and description are generally directed to an exemplary embodiment and it is contemplated that additions and modifications can be made without departing from the scope of the invention. As an example, the configuration of the depicted transfer device can be altered to provide mattresses of different shapes and sizes; the pontoon-like bounding portions can be provided on opposing sides of the patient support section, on all sides, and/or might separate adjacent patient support sections. The baffles may alternatively be formed of loops, e.g., substantially cylindrical baffles, of material rather than substantially planar strips. As such, the interiors of the loops may define passages extending from the first or bottom side of the patient support portion to the second or top side. In such embodiments, the lateral lengths of the baffles, e.g., the length from one bounding portion to the other bounding portion, may be interrupted. That is, a plurality of looped-shaped or cylindrical baffles may extend laterally across the width of the patient support portion. In addition, some or all of the bounding portions might be omitted, and possibly replaced with a descending skirt bounding the patient support portion. Rigidifying elements (e.g., poles) might be added to the mattress where rigidity is desired, e.g., about the opposing lateral sides of the patient support portion if the inflatable bounding portions are removed or omitted. It is contemplated that the first sheet, the second sheet, the third sheet, and/or the baffles or tethers may be joined to one another via any conventional technique including, for example, welding, an adhesive, a combination of such techniques, and/or other sealing methods.

It should be understood that the foregoing description and associated drawings are exemplary only and should not be construed as describing the only embodiments of the invention. The true scope of the invention is to be defined by the claims.

What is claimed:

1. A patient support device, comprising:

a first side for contacting a surface, including a perimeter portion and an inner portion;

a second side for contacting a patient, including a perimeter portion and an inner portion;

at least one baffle interconnected between the first and second sides, the at least one baffle including a first edge adjacent the first side, the first edge having a substantially concave shape relative to the surface;

an unloaded state including the perimeter portion of the first side being in contact with the surface, and the inner portion of the first side being spaced a first distance away from the surface; and a loaded state including the perimeter portion of the first side being in contact with the surface, and the inner portion of the first side being spaced a second distance away from the surface, the second distance being less than the first distance.

2. The device of claim 1, wherein the at least one baffle further includes:

a second edge adjacent the second side; and first and second lateral edges.

3. The device of claim 2, wherein the at least one baffle is a plurality of baffles.

4. The device of claim 3, wherein the plurality of baffles includes baffles interconnected between the first side and the second side at different angles with respect to the first side.

5. The device of claim 1, wherein:

the unloaded state further includes the inner portion of the second side spaced a third distance away from the surface; and the loaded state further includes the inner portion of the second side spaced a fourth distance away from the surface, the fourth distance is less than the third distance.

6. The device of claim 1, wherein the device is inflatable and the first side includes a plurality of apertures formed therein.

7. The device of claim 1, further including:

a first pontoon portion forming a part of the perimeter portion of the first side and forming a part of the perimeter portion of the second side; and a second pontoon portion forming a part of the perimeter portion of the first side and forming a part of the perimeter portion of the second side.

8. The device of claim 7, wherein the first and second pontoon portions are substantially round having respective widths that are greater than a distance between the first side and the second side when in the unloaded and loaded states.

9. The device of claim 1, wherein:

the first side includes a first sheet having a perimeter edge and a first lateral width;

the second side includes a second sheet having a perimeter edge and a second lateral width, the second lateral width being less than the first lateral width; and the perimeter of the first sheet is joined to the perimeter of the second sheet.

10. An inflatable patient transfer mattress, comprising:

a patient support portion including a first side adjacent a patient and a second adjacent a supporting surface and a second side adjacent a patient;

a first pontoon disposed on a first lateral side of the patient supporting portion;

a second pontoon disposed on a second lateral side of the patient supporting portion;

a plurality of tethers disposed laterally between the first and second pontoons and between the first side and the second side of the patient support portion, wherein the plurality of tethers includes at least one baffle including a first edge having a substantially concave shape relative to the surface;

an unloaded state including the first and second pontoons being in contact with the surface, and the first side of the patient support portion being spaced a first distance away from the surface; and a loaded state including the first and second pontoons being in contact with the surface, and the first side of the patient support portion being spaced a second distance away from the surface, the second distance being smaller than the first distance.

11. The mattress of claim 10, wherein:

the unloaded state further includes the second side of the patient support portion being spaced a third distance away from the surface; and the loaded state further includes the second side being spaced of the patient support portion spaced a fourth distance away from the surface, the fourth distance being smaller than the third distance.

12. The mattress of claim 11, wherein the mattress is configured to transition from the unloaded state to the loaded state.

13. The mattress of claim 10, wherein the at least one baffle includes:

the first edge adjacent the first side;

a second edge adjacent the second side; and first and second lateral edges.

14. The mattress of claim 10, wherein the first side includes a plurality of apertures formed therein configured to permit gas to escape from within an interior of the mattress and form a gas bearing between the first side and the surface.

15. The mattress of claim 14, wherein the gas bearing is substantially enclosed by the first and second pontoons when the mattress is in the unloaded and loaded states.

16. The mattress of claim 14, wherein the gas is air.

17. The mattress of claim 10, wherein the at least one baffle is a plurality of baffles, at least two of the plurality of baffles interconnected between the first and second sides at different angles with respect to the first side.

18. The mattress of claim 10, wherein:

the first side includes a first sheet having a perimeter edge and a first lateral width;

the second side includes a second sheet having a perimeter edge and a second lateral width, the second lateral width being less than the first lateral width; and the a perimeter of the first sheet is joined to the perimeter of the second sheet.

19. The mattress of claim 10, wherein the pontoons are void of tethers.

20. A patient support mattress, comprising:

a first bottom sheet for contacting a surface and having a first perimeter and a first width;

a second top sheet for contacting a patient and having a second perimeter and a second width, the second width being smaller than the first width;

the first perimeter joined to the second perimeter forming a first pontoon, forming a second pontoon, forming a patient support portion, and defining an internal plenum; and a plurality of baffles, each having a first substantially concave edge UP from the first bottom sheet and disposed adjacent and joined to the first bottom sheet, a second substantially linear edge disposed adjacent and joined to the second top sheet, and first and second lateral edges.

* * * * *

UNITED STATES PATENT AND TRADEMARK OFFICE

CERTIFICATE OF CORRECTION

PATENT NO. : 8,756,725 B2
APPLICATION NO. : 13/708247
DATED : June 24, 2014
INVENTOR(S) : Samuel Piegdon et al.

It is certified that error appears in the above-identified patent and that said Letters Patent is hereby corrected as shown below:

In the Claims

Claim 11, Col. 8, Line 64-66, "side being spaced of the patient support portion spaced" should read as --side of the patient support portion being spaced--.

Claim 20, Col. 10, Line 19, "UP" should read as --up--.

Signed and Sealed this
Thirteenth Day of January, 2015

Michelle K. Lee

Michelle K. Lee
*Deputy Director of the United States Patent and Trademark Office*